US009303825B2

(12) United States Patent
Boomgaarden et al.

(10) Patent No.: US 9,303,825 B2
(45) Date of Patent: Apr. 5, 2016

(54) HIGH BAY LUMINAIRE

(71) Applicant: LIGHTING SCIENCE GROUP CORPORATION, Satellite Beach, FL (US)

(72) Inventors: Mark Penley Boomgaarden, Satellite Beach, FL (US); Eric Holland, Indian Harbour Beach, FL (US); Ricardo Romeu, Melbourne, FL (US); Ryan Kelley, Denver, CO (US)

(73) Assignee: Lighting Science Group, Corporation, Melbourne, FL (US)

( * ) Notice: Subject to any disclaimer, the term of this patent is extended or adjusted under 35 U.S.C. 154(b) by 206 days.

(21) Appl. No.: 14/198,275

(22) Filed: Mar. 5, 2014

(65) Prior Publication Data

US 2014/0254144 A1 Sep. 11, 2014

Related U.S. Application Data

(60) Provisional application No. 61/772,755, filed on Mar. 5, 2013.

(51) Int. Cl.
*F21K 99/00* (2010.01)
*F21S 2/00* (2006.01)
(Continued)

(52) U.S. Cl.
CPC . *F21K 9/30* (2013.01); *F21S 2/005* (2013.01); *F21S 8/026* (2013.01); *F21V 23/0435* (2013.01); *F21V 23/0442* (2013.01); *F21Y 2101/02* (2013.01)

(58) Field of Classification Search
CPC ..... F21K 9/30; F21S 2/005; F21S 8/026; F21V 23/0435; F21V 23/0442; F21Y 2101/02
See application file for complete search history.

(56) References Cited

U.S. PATENT DOCUMENTS 3,869,605 A 3/1975 Davis
3,930,335 A 1/1976 Widmayer et al.
(Continued)

FOREIGN PATENT DOCUMENTS

DE 202004009616 11/2004
DE 102010004042 A1 7/2011
(Continued)

OTHER PUBLICATIONS

US 4,970,436, 11/1990, Sacchetti (withdrawn).
(Continued)

*Primary Examiner* — Mary Ellen Bowman
(74) *Attorney, Agent, or Firm* — Mark Malek; Stephen Bullock; Widerman Malek, PL

(57) ABSTRACT

A high bay luminaire system and method for forming the same includes a body member, a power supply, and a light source. The body member includes a plurality of end sections, a plurality of intermediate sections which may be attached to the plurality of end sections, a central section which is positioned between the plurality of intermediate sections and is attached to the plurality of end sections, and a plurality of side sections which are attached to an end section of the plurality of end sections and/or an intermediate section of the plurality of intermediate sections. The light source is in electrical communication with the power supply. The cavity is defined by the plurality of end sections and the central section. The plurality of end sections, the plurality of intermediate sections, the central section, and/or the plurality of side sections are formed of sheet metal.

21 Claims, 8 Drawing Sheets

(51) Int. Cl.

| | |
|---|---|
| ***F21S 8/02*** | (2006.01) |
| ***F21V 23/04*** | (2006.01) |
| *F21Y 101/02* | (2006.01) |

(56) References Cited

U.S. PATENT DOCUMENTS

| | | | |
|---|---|---|---|
| 3,931,695 | A | 1/1976 | Widmayer et al. |
| 4,551,654 | A | 11/1985 | Barnum et al. |
| 4,942,384 | A | 7/1990 | Yamauchi et al. |
| 5,012,609 | A | 5/1991 | Ignatius et al. |
| 5,278,432 | A | 1/1994 | Ignatius et al. |
| 5,319,301 | A | 6/1994 | Callahan et al. |
| 5,523,878 | A | 6/1996 | Wallace et al. |
| 5,563,422 | A | 10/1996 | Nakamura et al. |
| 5,659,977 | A | 8/1997 | Jensen et al. |
| 5,747,976 | A | 5/1998 | Wong et al. |
| 5,936,599 | A | 8/1999 | Reymond et al. |
| 5,997,150 | A | 12/1999 | Anderson |
| 6,140,646 | A | 10/2000 | Busta et al. |
| 6,211,626 | B1 | 4/2001 | Lys et al. |
| 6,272,154 | B1 | 8/2001 | Bala et al. |
| 6,341,876 | B1 | 1/2002 | Moss et al. |
| 6,356,700 | B1 | 3/2002 | Strobl |
| 6,474,838 | B2 | 11/2002 | Fang et al. |
| 6,554,450 | B2 | 4/2003 | Fang et al. |
| 6,561,656 | B1 | 5/2003 | Kojima et al. |
| 6,594,090 | B2 | 7/2003 | Kruschwitz et al. |
| 6,733,135 | B2 | 5/2004 | Dho |
| 6,767,111 | B1 | 7/2004 | Lai |
| 6,817,735 | B2 | 11/2004 | Shimizu et al. |
| 6,853,150 | B2 | 2/2005 | Clauberg et al. |
| 6,870,523 | B1 | 3/2005 | Ben-David et al. |
| 6,871,982 | B2 | 3/2005 | Holman et al. |
| 6,876,007 | B2 | 4/2005 | Yamazaki et al. |
| 6,921,182 | B2 | 7/2005 | Anderson et al. |
| 6,967,761 | B2 | 11/2005 | Starkweather et al. |
| 6,974,713 | B2 | 12/2005 | Patel et al. |
| 7,042,623 | B1 | 5/2006 | Huibers et al. |
| 7,066,628 | B2 | 6/2006 | Allen |
| 7,070,281 | B2 | 7/2006 | Kato |
| 7,072,096 | B2 | 7/2006 | Holman et al. |
| 7,075,707 | B1 | 7/2006 | Rapaport et al. |
| 7,083,304 | B2 | 8/2006 | Rhoads |
| 7,086,756 | B2 | 8/2006 | Maxik et al. |
| 7,086,767 | B2 | 8/2006 | Sidwell |
| 7,138,770 | B2 | 11/2006 | Uang et al. |
| 7,178,941 | B2 | 2/2007 | Roberge et al. |
| 7,184,201 | B2 | 2/2007 | Duncan |
| 7,246,923 | B2 | 7/2007 | Conner |
| 7,255,469 | B2 | 8/2007 | Wheatley et al. |
| 7,261,453 | B2 | 8/2007 | Morejon et al. |
| 7,289,090 | B2 | 10/2007 | Morgan |
| 7,300,177 | B2 | 11/2007 | Conner |
| 7,303,291 | B2 | 12/2007 | Ikeda et al. |
| 7,325,956 | B2 | 2/2008 | Morejon et al. |
| 7,342,658 | B2 | 3/2008 | Kowarz et al. |
| 7,344,279 | B2 | 3/2008 | Mueller et al. |
| 7,349,095 | B2 | 3/2008 | Kurosaki |
| 7,400,439 | B2 | 7/2008 | Holman |
| 7,427,146 | B2 | 9/2008 | Conner |
| 7,429,983 | B2 | 9/2008 | Islam |
| 7,434,946 | B2 | 10/2008 | Huibers |
| 7,438,443 | B2 | 10/2008 | Tatsuno et al. |
| 7,476,016 | B2 | 1/2009 | Kurihara |
| 7,489,086 | B2 | 2/2009 | Miskin et al. |
| 7,520,642 | B2 | 4/2009 | Holman et al. |
| 7,530,708 | B2 | 5/2009 | Park |
| 7,537,347 | B2 | 5/2009 | Dewald |
| 7,540,616 | B2 | 6/2009 | Conner |
| 7,567,040 | B2 | 7/2009 | Pong et al. |
| 7,588,351 | B2 | 9/2009 | Meyer |
| 7,598,682 | B2 | 10/2009 | Grajcar |
| 7,598,686 | B2 | 10/2009 | Lys et al. |
| 7,604,378 | B2 | 10/2009 | Wolf et al. |
| 7,605,971 | B2 | 10/2009 | Ishii et al. |
| 7,607,798 | B2 | 10/2009 | Panotopoulos |
| 7,617,057 | B2 | 11/2009 | May et al. |
| 7,626,755 | B2 | 12/2009 | Furuya et al. |
| 7,677,736 | B2 | 3/2010 | Kasazumi et al. |
| 7,684,007 | B2 | 3/2010 | Hull et al. |
| 7,703,943 | B2 | 4/2010 | Li et al. |
| 7,708,452 | B2 | 5/2010 | Maxik et al. |
| 7,709,811 | B2 | 5/2010 | Conner |
| 7,719,766 | B2 | 5/2010 | Grasser et al. |
| 7,728,846 | B2 | 6/2010 | Higgins |
| 7,732,825 | B2 | 6/2010 | Kim et al. |
| 7,766,490 | B2 | 8/2010 | Harbers et al. |
| 7,819,556 | B2 | 10/2010 | Heffington et al. |
| 7,828,453 | B2 | 11/2010 | Tran et al. |
| 7,828,465 | B2 | 11/2010 | Roberge et al. |
| 7,832,878 | B2 | 11/2010 | Brukilacchio et al. |
| 7,834,867 | B2 | 11/2010 | Sprague et al. |
| 7,835,056 | B2 | 11/2010 | Doucet et al. |
| 7,841,714 | B2 | 11/2010 | Gruber |
| 7,845,823 | B2 | 12/2010 | Mueller et al. |
| 7,852,017 | B1 | 12/2010 | Melanson |
| 7,871,839 | B2 | 1/2011 | Lee et al. |
| 7,880,400 | B2 | 2/2011 | Zhoo et al. |
| 7,889,430 | B2 | 2/2011 | El-Ghoroury et al. |
| 7,902,769 | B2 | 3/2011 | Shteynberg et al. |
| 7,906,789 | B2 | 3/2011 | Jung et al. |
| 7,928,565 | B2 | 4/2011 | Brunschwiler et al. |
| 7,972,030 | B2 | 7/2011 | Li |
| 7,976,205 | B2 | 7/2011 | Grotsch et al. |
| 8,016,443 | B2 | 9/2011 | Falicoff et al. |
| 8,022,634 | B2 | 9/2011 | Greenfeld et al. |
| 8,040,070 | B2 | 10/2011 | Myers et al. |
| 8,047,660 | B2 | 11/2011 | Penn et al. |
| 8,049,763 | B2 | 11/2011 | Kwak et al. |
| 8,061,080 | B2 | 11/2011 | Loebl et al. |
| 8,061,857 | B2 | 11/2011 | Liu et al. |
| 8,070,302 | B2 | 12/2011 | Hatanaka et al. |
| 8,074,397 | B2 | 12/2011 | Yoneda et al. |
| 8,076,680 | B2 | 12/2011 | Lee et al. |
| 8,096,668 | B2 | 1/2012 | Abu-Ageel |
| 8,115,419 | B2 | 2/2012 | Given et al. |
| 8,188,687 | B2 | 5/2012 | Lee et al. |
| 8,212,494 | B2 | 7/2012 | Veltman et al. |
| 8,214,084 | B2 | 7/2012 | Simon et al. |
| 8,324,840 | B2 | 12/2012 | Shteynberg et al. |
| 8,410,717 | B2 | 4/2013 | Shteynberg et al. |
| 8,441,210 | B2 | 5/2013 | Shteynberg et al. |
| 8,453,376 | B2 | 6/2013 | Chen et al. |
| 8,674,608 | B2 | 3/2014 | Holland et al. |
| 2001/0018828 | A1 | 9/2001 | Kadotani |
| 2001/0047618 | A1 | 12/2001 | Fang et al. |
| 2004/0052076 | A1 | 3/2004 | Mueller et al. |
| 2004/0109302 | A1 | 6/2004 | Yoneda |
| 2005/0281027 | A1 | 12/2005 | Capen |
| 2006/0002108 | A1 | 1/2006 | Ouderkirk et al. |
| 2006/0002110 | A1 | 1/2006 | Dowling et al. |
| 2006/0022214 | A1 | 2/2006 | Mueller et al. |
| 2006/0053691 | A1 | 3/2006 | Harwood et al. |
| 2006/0164005 | A1 | 7/2006 | Sun |
| 2006/0176686 | A1 | 8/2006 | McVicker et al. |
| 2006/0232992 | A1 | 10/2006 | Bertram et al. |
| 2006/0285193 | A1 | 12/2006 | Kimura et al. |
| 2007/0013871 | A1 | 1/2007 | Marshall et al. |
| 2007/0058368 | A1 | 3/2007 | Partee et al. |
| 2007/0159492 | A1 | 7/2007 | Lo et al. |
| 2007/0188847 | A1 | 8/2007 | McDonald et al. |
| 2007/0241340 | A1 | 10/2007 | Pan |
| 2008/0143973 | A1 | 6/2008 | Wu |
| 2008/0198572 | A1 | 8/2008 | Medendorp |
| 2008/0232084 | A1 | 9/2008 | Kon |
| 2008/0258643 | A1 | 10/2008 | Cheng et al. |
| 2009/0009102 | A1 | 1/2009 | Kahlman et al. |
| 2009/0059099 | A1 | 3/2009 | Linkov et al. |
| 2009/0059585 | A1 | 3/2009 | Chen et al. |
| 2009/0128781 | A1 | 5/2009 | Li |
| 2009/0160370 | A1 | 6/2009 | Tai et al. |
| 2009/0175041 | A1 | 7/2009 | Yuen et al. |
| 2009/0199470 | A1 | 8/2009 | Capen |
| 2009/0200952 | A1 | 8/2009 | King et al. |

(56) References Cited

U.S. PATENT DOCUMENTS

| | | | |
|---|---|---|---|
| 2009/0261748 | A1 | 10/2009 | McKinney et al. |
| 2009/0262516 | A1 | 10/2009 | Li |
| 2010/0006762 | A1 | 1/2010 | Yoshida et al. |
| 2010/0051976 | A1 | 3/2010 | Rooymans |
| 2010/0060181 | A1 | 3/2010 | Choi et al. |
| 2010/0061068 | A1 | 3/2010 | Geissler et al. |
| 2010/0061078 | A1 | 3/2010 | Kim |
| 2010/0072494 | A1 | 3/2010 | Lee |
| 2010/0103389 | A1 | 4/2010 | McVea et al. |
| 2010/0115830 | A1 | 5/2010 | Dube |
| 2010/0202129 | A1 | 8/2010 | Abu-Ageel |
| 2010/0231136 | A1 | 9/2010 | Reisenauer et al. |
| 2010/0231863 | A1 | 9/2010 | Hikmet et al. |
| 2010/0244700 | A1 | 9/2010 | Chong et al. |
| 2010/0244724 | A1 | 9/2010 | Jacobs et al. |
| 2010/0259190 | A1 | 10/2010 | Aikala |
| 2010/0270942 | A1 | 10/2010 | Hui et al. |
| 2010/0277067 | A1 | 11/2010 | Maxik et al. |
| 2010/0277084 | A1 | 11/2010 | Lee et al. |
| 2010/0287830 | A1 | 11/2010 | Chen et al. |
| 2010/0302464 | A1 | 12/2010 | Raring et al. |
| 2010/0315320 | A1 | 12/2010 | Yoshida |
| 2010/0320927 | A1 | 12/2010 | Gray et al. |
| 2010/0320928 | A1 | 12/2010 | Kaihotsu et al. |
| 2010/0321641 | A1 | 12/2010 | Van Der Lubbe |
| 2010/0321933 | A1 | 12/2010 | Hatanaka et al. |
| 2011/0012137 | A1 | 1/2011 | Lin et al. |
| 2011/0209400 | A1 | 9/2011 | Rooymans |
| 2011/0248640 | A1 | 10/2011 | Welten et al. |
| 2011/0309759 | A1 | 12/2011 | Shteynberg et al. |
| 2012/0286672 | A1 | 11/2012 | Holland et al. |
| 2012/0287245 | A1 | 11/2012 | Holland et al. |
| 2012/0287271 | A1 | 11/2012 | Holland et al. |
| 2013/0139437 | A1 | 6/2013 | Maxik et al. |
| 2013/0201290 | A1 | 8/2013 | Holland et al. |
| 2013/0223067 | A1* | 8/2013 | Ito ..... F21V 19/02 362/235 |

FOREIGN PATENT DOCUMENTS

| | | | |
|---|---|---|---|
| EP | 1479286 | A1 | 11/2004 |
| EP | 1933602 | | 12/2007 |
| EP | 1925709 | | 5/2008 |
| JP | 08103167 | | 4/1996 |
| JP | 08242694 | | 9/1996 |
| JP | 3070828 | | 5/2000 |
| JP | 2000-156526 | | 6/2000 |
| WO | WO 02/16824 | | 2/2002 |
| WO | WO 03/055273 | | 7/2003 |
| WO | WO 2005/089477 | | 9/2005 |
| WO | WO 2005/109532 | | 11/2005 |
| WO | WO 2006/095315 | | 9/2006 |
| WO | WO 2007/125477 | | 11/2007 |
| WO | WO 2008/002073 | | 1/2008 |
| WO | WO 2009/022016 | | 2/2009 |
| WO | WO 2010/013998 | | 2/2010 |
| WO | WO 2010/027459 | | 3/2010 |
| WO | WO 2010/098811 | | 9/2010 |
| WO | WO 2011/008251 | | 1/2011 |
| WO | WO 2011/016860 | | 2/2011 |
| WO | WO 2013/082588 | | 6/2013 |

OTHER PUBLICATIONS

US 4,992,701, 8/1991, Sacchetti (withdrawn).

International Search Report and Written Opinion for PCT/US2013/027226 dated Nov. 18, 2013.

Stutte, et al., "Photoregulation of Bioprotectant Content of Red Leaf Lettuce with Light-emitting Diodes", HortScience, vol. 44(1), pp. 79-82, Feb. 2009.

Stutte, Gary, "Light-emitting Diodes for Manipulating the Phytochrome Apparatus", HortScience, vol. 44(2), pp. 231-234, Apr. 2009.

Tannith Cattermole, "Smart Energy Glass controls light on demand", Gizmag.com, Apr. 18, 2010, accessed Nov. 1, 2011.

* cited by examiner

HIGH BAY LUMINAIRE

RELATED APPLICATIONS

This application claims benefit under 35 U.S.C. §119(e) of U.S. Provisional Patent Application Ser. No. 61/772,755 filed on Mar. 5, 2013 and titled High Bay Luminaire, the contents of which is incorporated in its entirety herein by reference. This application is also related to U.S. patent application Ser. No. 13/464,345 filed on May 4, 2012 and titled Occupancy Sensor and Associated Methods, the entire contents of which are incorporated herein by reference. This application is also related to U.S. Design Patent Application Ser. No. 29/443,158 filed on Jan. 14, 2013 and titled High Bay Light Fixture, the entire contents of which are incorporated herein by reference. This application is also related to U.S. patent application Ser. No. 13/681,522 filed on Nov. 20, 2012 and titled Illumination and Grow Light System and Associated Methods, the entire contents of which are incorporated herein by reference. In each incorporated reference, disclosures made therein are incorporated herein except to the extent disclosures therein are inconsistent with disclosures herein.

FIELD OF THE INVENTION

The present invention relates generally to light fixtures and, more particularly, to high bay LED luminaires.

BACKGROUND OF THE INVENTION

A luminaire is an electrical device used to create light by use of an electric lamp system, outputting light into an environment. A luminaire is also able to control and distribute the light it produces. Luminaires are used in indoor or outdoor applications.

A high bay luminaire is a lighting device that may be designed for industrial locations high above floor or work level. Many high bay luminaires may be expensive or over engineered. As a result, users are faced with choices for devices that provide unnecessary functions at a price that the user may find prohibitive. Further, the manufacturing and shipping costs of current high bay lighting devices can be very expensive. Therefore, there is a need for a high bay luminaire that is better suited to the needs of users, and that can be readily manufactured and shipped for a reasonable price.

SUMMARY OF THE INVENTION

With the above in mind, embodiments of the present invention are related to providing high bay luminaires and, more particularly, economical and stackable high bay luminaires that may provide downlighting as well as uplighting, and possess favorable heat dissipation properties.

In accordance with one embodiment of the invention, a high bay luminaire is provided. The high bay luminaire may include a plurality or end sections, a plurality side of sections, a plurality of intermediate sections and a central section. The central section may be positioned between the intermediate sections. The intermediate sections are connected to the side sections. The central, intermediate and side sections may then connect to an end section at either end. The central section may include a cavity which houses the power supply which may be in electrical communication with a light source. The light source may be housed in the side sections which may also function as a heat sink.

An alternative embodiment of a high bay luminaire may include a lighting device with a monolithic sheet metal housing. The central, side and end sections of the alternative embodiment may be fashioned from sheet metal in a continuous form. The side sections of the alternative embodiment may be perforated and connect directly to, or may be integrally formed with, the central section. The central and side sections may then connect to an end section at either end. The central section may include a cavity which houses the power supply, which in turn may be in electrical communication with a light source. The light source may be housed in the side sections which may also function as a heat sink.

In accordance with one embodiment of a high bay luminaire system, the high bay luminaire may include a body member which may include a plurality of end sections, a plurality of intermediate sections which may be attached to the plurality of end sections, a central section which may be positioned between the plurality of intermediate sections and may be attached to the plurality of end sections, and a plurality of side sections which may be attached to an end section of the plurality of end sections or an intermediate section of the plurality of intermediate sections. The high bay luminaire may also include a power supply and a light source.

The light source may be in electrical communication with the power supply. The cavity may be defined by the plurality of end sections and the central section. One of the plurality of end sections, the plurality of intermediate sections, the central section, and the plurality of side sections may be formed of sheet metal.

The central section may further include a power supply cover and the cavity may be defined additionally by the power supply cover. The light source may include a plurality of light sources which may be disposed on the plurality of side sections and the light source may be in thermal communication with the plurality of side sections.

The plurality of side sections and/or the plurality of intermediate sections may include a plurality of openings. The plurality of side sections and/or the plurality of intermediate sections may be in thermal communication with the light source.

The high bay luminaire system may further include an electrical sensor. The electrical sensor may include a controller which may be configured to detect a status relevant to the operation of the high bay luminaire and may generate an operating signal responsive to the detected status. The electrical sensor may include a motion detector, an occupancy sensor, a thermal detector, a timer, and/or a wireless communication device. The electrical sensor may be configured to communicate with other luminaires and/or other electrical devices via a wired connection and/or a wireless connection.

The high bay luminaire system may further include a chain mounting and/or a hook mounting. A high bay luminaire system may further include an access plate. The high bay luminaire system may further include an uplight module which may be disposed on the plurality of intermediate sections, the plurality of side sections, and/or the plurality of end sections and the light source may be disposed on the uplight module.

The body member may be configured to be stackable with the body member of another high bay luminaire system. The plurality of intermediate sections, the central section, and the plurality of side sections may be fabricated of sheet metal. The power supply may be positioned within the cavity and the power supply cover, the plurality of end sections, and/or the central section may include a passageway. The high bay luminaire system may further include a battery which may be attached to the body member and may be positioned in electrical communication with the power supply and/or the light source. The light source may include a light emitting diode (LED).

In accordance with one embodiment of the invention, a method for forming a high bay luminaire is provided. A method of creating a high bay luminaire system which may include a body member, a power supply, and a light source. The body member may include a plurality of end sections, a plurality of intermediate sections which may be attached to the plurality of end sections, a central section which may be positioned between the plurality of intermediate sections and may be attached to the plurality of end sections at a generally central part of the plurality of end sections and wherein a cavity may be positioned, and a plurality of side sections which may be attached to the plurality of end sections. The method may include the steps of forming each end section from a first piece of metal, forming each side section from a second piece of metal, forming each intermediate section from a third piece of metal, forming the central section from a fourth piece of metal, assembling the plurality of end sections, the plurality of side sections, the plurality of intermediate sections, and the central section to form the body member, and attaching the power supply to the body member and positioning the power supply in electrical communication with the light source. The body member may be configured to be stackable with the body member of another high bay luminaire system.

The method may further include the step of attaching the light source to the body member. The method may further include any of the steps of attaching an electrical sensor to the body member, attaching a chain mounting and/or a hook mounting to the body member, and attaching an access plate to the body member.

The method may further include the step of forming a plurality of openings in the plurality of side sections and/or the plurality of intermediate sections. The plurality of side sections and/or the plurality of intermediate sections may be in thermal communication with the light source.

The method may further include the step of attaching an uplight module. The light source may be disposed on the body member and/or the uplight module.

The first piece of metal, the second piece of metal, the third piece of metal, and/or the fourth piece of metal may be sheet metal. At least two of the first piece of metal, the second piece of metal, the third piece of metal, and the fourth piece of metal may be collectively formed from a single piece of metal.

DETAILED DESCRIPTION OF THE PREFERRED EMBODIMENT

Figure 1:
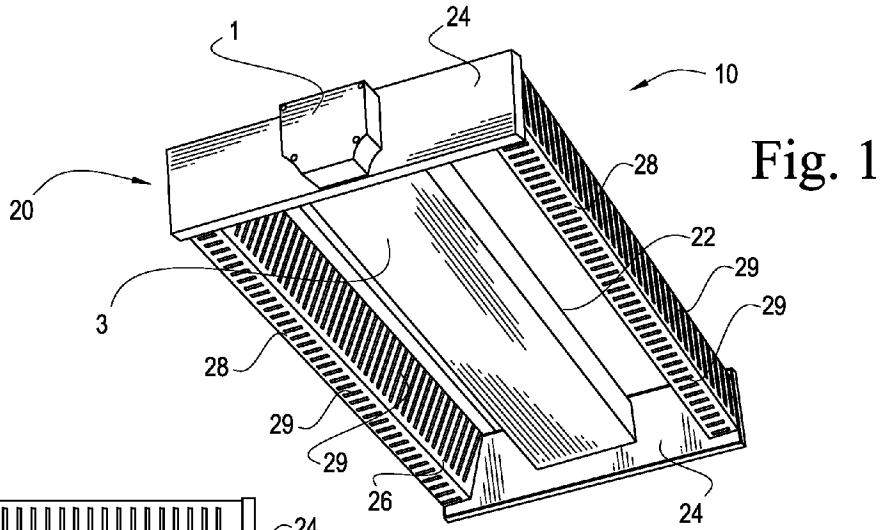
FIG. 1 is a bottom perspective view of an embodiment of a high bay luminaire of the present invention.
Figure 2:
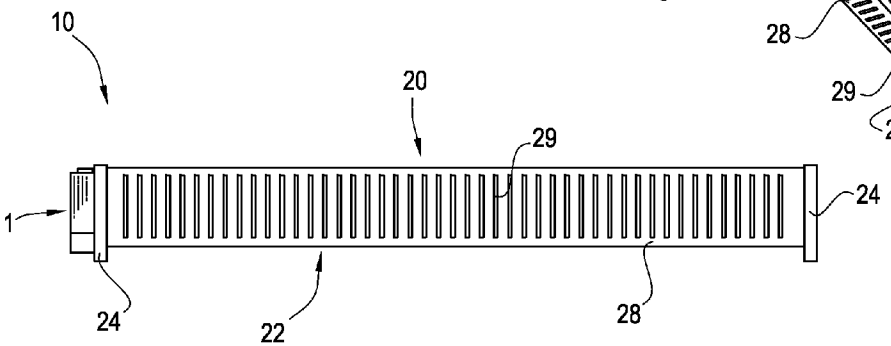
FIG. 2 is a side elevation view of the high bay luminaire illustrated in FIG. 1.
Figure 3:
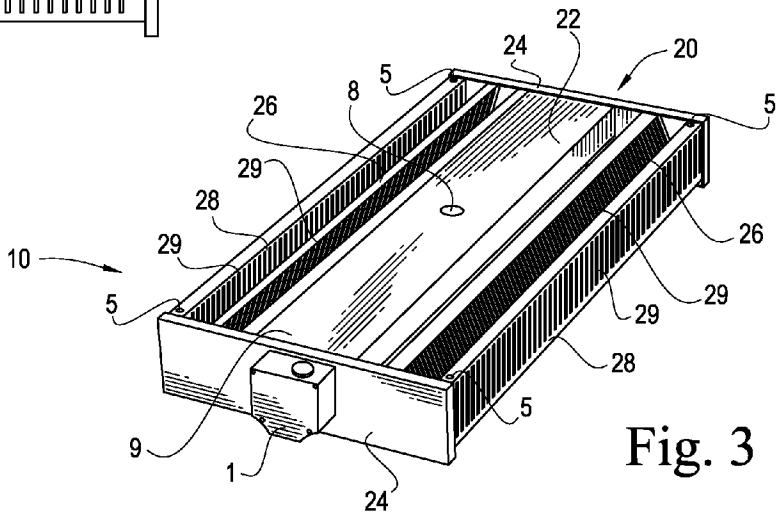
FIG. 3 is a top perspective view of the high bay luminaire illustrated in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure. Like numbers refer to like elements throughout, and prime notation is used to denote similar elements in alternative embodiments of the invention.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Example methods and systems for a high bay luminaire are described herein below. In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not limitation.

Referring now to FIGS. 1-5, a high bay luminaire 10 according to an embodiment of the present invention is now described in detail. Throughout this disclosure, the present invention may be referred to as a high bay luminaire, a luminaire, or a high bay LED luminaire. Those skilled in the art will appreciate that this terminology does not affect the scope of the invention as outlined herein.

A high bay luminaire 10 according to an embodiment of the present invention is now described in greater detail. The high bay luminaire 10 may include a body member 20, a light source 4, an electrical sensor 1, a power supply 2 and a power supply cover 3. As will be discussed in greater detail below, the light source 4 may be provided by a light emitting diode (LED), or any other number of light sources.

The body member 20 may be configured to function as a housing for the various other elements of the high bay luminaire 10. The body member 20 may be formed of any material suitable to carry the elements of the high bay luminaire 10. Additionally, the body member 20 may be formed of any suitable material and configured to shield the elements of the high bay luminaire 10 from environmental factors that may impair its function. Furthermore, the body member 20 may be formed of a material having desirous thermal properties, such as having a desirable thermal conductivity. For example, the body member 20 may be formed of metal or metal alloy. As a further example, the body member 20 may be formed of sheet metal.

Continuing to refer to FIGS. 1-5, additional features of the body member 20 are now described. The body member 20 may comprise a central section 22, end sections 24, intermediate sections 26, and side sections 28. Each end of the central section 22 may be attached to the end sections 24 at a generally central part of the end sections 24. Similarly, each of the intermediate sections 26 and the side sections 28 may have two ends, to which the end sections 24 are also attached. The central section 22 may be attached to the end sections 24 by any suitable means or methods known in the art, including, but not limited to, welding, fasteners, glues, adhesives, riveting, and the like. Additionally, in some embodiments, each of the central section 22, end sections 24, intermediate sections 26, and side sections 28 may be formed as a single integral structure, thereby obviating any attachment. In other words, the central section 22, the end section 24, the intermediate sections 26 and the side sections 28 may be integrally formed as a monolithic unit. This may be accomplished in any number of ways, as will be understood by those skilled in the art. Additionally, it is contemplated and included within the scope of the invention that any combination of the central section 22, the end sections 24, the intermediate sections 26 and the side sections 28 may be integrally formed as a monolithic unit.

In the present embodiment, the body member 20 may be configured to have a generally open design, permitting the free flow of air through the various sections of the body member 20. More specifically, any and/or each of the central section 22, the intermediate sections 26, and the side sections 28 may be attached to the end sections 24 in a spaced-apart fashion, thereby offsetting each of the elements from the others and permitting the free flow of air therebetween. This may facilitate the dissipation of heat from the electrical elements of the high bay luminaire 10. Moreover, the central section 22, end sections 24, intermediate sections 26, and side sections 28 may all be in thermal communication with one another, either directly or indirectly, or in various combinations thereof. This may prevent the concentration of heat in any part of the high bay luminaire 10 and facilitate the dissipation of heat across the entirety of the body member 20.

Any of the various sections of the body member 20 may be further configured to increase the thermal dissipation capacity thereof. In the present embodiment, each of the intermediate sections 26 and the side sections 28 may comprise a plurality of openings 29 (also referred to herein as perforations) formed therein. The plurality of openings 29 may be configured to increase the surface area and permit the flow of air therethrough, both of which tend to increase the thermal dissipation capacity of those sections and the light source 4. Such configurations may advantageously increase the thermal dissipation capacity of the body member 20. In the present embodiment, the plurality of openings 29 is configured as a series of parallel vertical openings. Other configurations are contemplated, including openings of any geometry, repeating or non-repeating configurations, and the like. The configuration of the plurality of openings 29 may be selected so as to increase the thermal dissipation capacity of the body member 20 while maintaining sufficient structural strength to ensure the safe operation of the high bay luminaire 10 as well as ensuring its integrity when in transit. The plurality of openings 29 may also be configured to prevent and/or not enable foreign particles, such as dust and external debris, entering the high bay luminaire 10 or impairing the operation of the high bay luminaire 10, its parts, or its components. Additionally, in some embodiments, the body member 20 may include indentations, grooves, or other surface features that do not form an opening but do increase the thermal dissipation capacity of the body member 20. The description of these configurations, however, are meant to be exemplary only and non-limiting.

Figure 4:
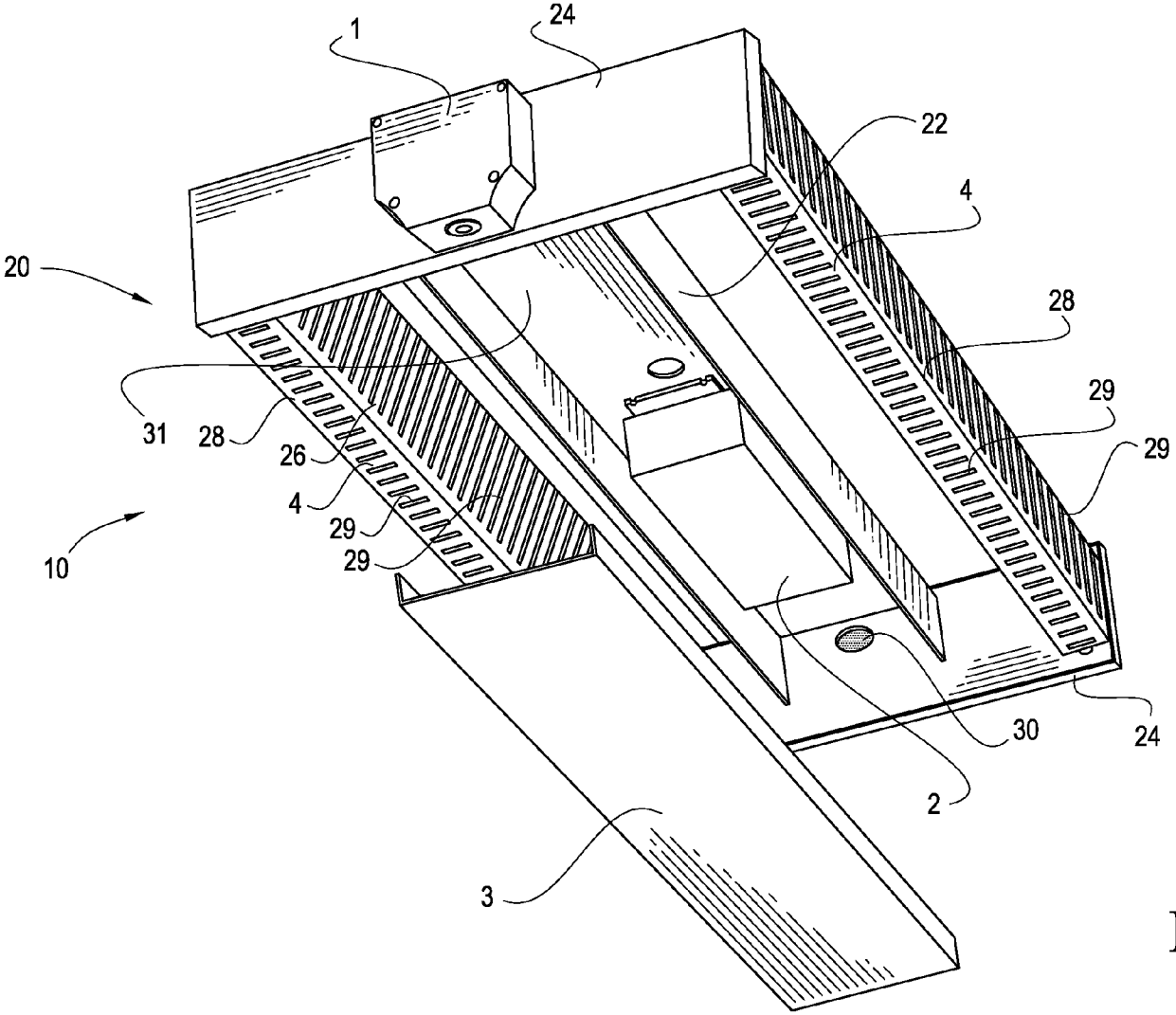
FIG. 4 is a bottom perspective view of the high bay luminaire illustrated in FIG. 1 and showing a power supply cover of the high bay luminaire detached therefrom.

Referring now to FIG. 4, the power supply 2 will be discussed in greater detail. The power supply 2 may be configured to supply power to various electrical elements of the high bay luminaire 10, such as the light sources 4 and the electrical sensor 1. Furthermore, the power supply 2 may be electrically connected to an external power source, such as a power grid, from which the power supply 2 may draw electrical power to provide to the connected electrical elements of the high bay luminaire 10. The power supply 2 may be positioned in electrical communication with the various electrical elements of the high bay luminaire 10. The power supply 2 may comprise the necessary electrical components to modify and condition electrical power received from the external power source so that it may be used by the electrical elements of the high bay luminaire 10 in their operation and without causing damage thereto. In some embodiments, the power supply 2 may further comprise a battery so that the electrical elements of the high bay luminaire 10 may continue operation if the electrical connection with the external power source is lost.

The power supply cover 3 may be adapted to engage a bottom portion of the central section 22 to cover a cavity 31 that is defined by the power supply cover 3, the end sections 24 and the central section 22. The cavity 31 may be used to house elements of the high bay luminaire 10 such as the power supply 2.

The body member 20 may further include passageways 30 formed within the elements defining the cavity 31 so as to permit the positioning of wires therethrough. For example, in the present embodiment, the body member 20 may include a passageway 30 formed in the end sections 24 so that wires can be fed into the power supply 2 and any other elements located within the cavity 31. Passageways 30 may be formed in any part of the body member 20, including those defining the cavity 31. Skilled artisans may include other elements in the central section 22 for successful operation of the high bay luminaire 10 without departing from the scope of the invention.

The power supply cover 3 may advantageously protect the power supply 2 from any environmental conditions that may adversely affect the operation of the power supply 2 while simultaneously providing ease of access thereto. The power supply cover 3 may be connected in such a manner that it swings on a hinge when a user desires to open the power supply cover 3, facilitating tool-less access to the power supply 2. However, the power supply cover 3 may be configured to attach to the high bay luminaire 10 in any manner known in the art, including, without limitation, fasteners, clasps, welding, adhesives, hinges, and magnetic coupling. Additionally, a user may access the power supply 2 from below the high bay luminaire 10 through the temporary removal or repositioning of the power supply cover 3 through any of the above mentioned attachment means, methods, and devices.

The light source 4 may be any illuminant or device capable of being operated to emit light. Examples of such illuminants include, but are not limited to, incandescent light bulbs, fluorescent lights, light-emitting semiconductors such as light emitting diodes (LEDs), arc lights, halogen lamps, and any other device known in the art. In the present embodiment, the light source 4 may be at least two columns of LEDs and may be attached to a lower surface of the intermediate sections 26 or the side sections 28. Skilled artisans would appreciate that the layout of the light source may include a different configuration such as, without limitation, a single column of LEDs, without departing from the scope of the invention.

The high bay luminaire 10 may further include electrical leads (not shown) extending from the power supply 2 to the light source 4. The leads may extend from the power supply 2 and connect to the light source 4 through the passageway 30 (as shown in FIG. 4). In an alternative embodiment, the leads may extend to the light source 4 from the power supply 2 by any means that allows a secure electrical connection whilst ensuring the leads are not exposed to environmental elements.

The light source 4 may be positioned on either side of the high bay luminaire 10. In one embodiment, a light source 4 may be housed in the underside of each side section 28. In another embodiment, the light source 4 may attach to each of the side sections 28 and the intermediate sections 26, placing the light source 4 in direct thermal communication with the side section 28, the intermediate section 26, or both sections, thereby reducing the concentration of heat in the high bay luminaire 10. A light source 4 may also be positioned on the top of the side section 28. In an alternative embodiment, an upward facing light source 4 may be housed between the intermediate section 26 and the side section 28. As a result, the high bay luminaire 10 may provide uplighting and downlighting. The plurality of openings 29 may also assist the high bay luminaire 10 to illuminate a greater area as light that filters through the plurality of openings 29 may also provide illumination.

The power supply cover 3 may be fabricated from sheet metal or another material with similar properties as known to persons having ordinary skill in the art. In the present embodiment of the invention, a cover 3 made from sheet metal can be made without casting and instead can be manufactured using standard sheet metal processes, which lowers the cost of manufacturing.

In an alternative embodiment, the power supply cover 3 may include additional holes, perforations, or other features to increase the thermal dissipation capacity of the luminaire 10. The cover 3 may also be manufactured from a material that increases the dissipation efficiency such as aluminum and/or painted with a material that will reduce thermal resistance between the light source 4 and the power supply cover 3. In order to increase the capacity to dissipate heat, the light source 4 may connect mechanically to the power supply cover 3 to cause the total heat sink surface area to increase and, as a consequence, increase the capacity of the light source 4 and housing to dissipate heat.

The body member 20 includes side sections 28, central section 22 and end sections 24 that may be assembled from a lightweight, durable material such as, but not limited to, sheet metal. Sheet metal is relatively inexpensive, possesses excellent thermal properties and is easily fashioned into a desired shape. Skilled artisans may manufacture a luminaire where the sections are not all fabricated from the same material without departing from the scope of the invention. Each section may be manufactured separately before the entire unit is assembled. The end sections 24 may be manufactured in such a manner that they extend further than the side sections 28 to which they are attached to protect the side sections 28 during shipping, handling and installation for example. Those skilled in the art will appreciate that the side sections 28, central section 22 and end section 24 of the body member 20 may be integrally formed as a monolithic unit.

A single piece of sheet metal may be utilized to form the end section 24 by shaping the sheet metal to form the end section 24. The side section 28 and the intermediate section 26 may also be formed from a single piece of sheet metal. The central section 22 may also be formed from a single piece of sheet metal. These sections may then be assembled into a high bay luminaire 10. The sheet metal parts may be manufactured by a sequence of bending, cutting, countersinking and hole punching operations. The manufacturing process may start with a flat piece of sheet metal and end with a three-dimensional object of inter-connected planes.

An electrical sensor 1 may be attached to the end section 24 of the body member 20. In an alternative embodiment, multiple electrical sensors 1 may be attached to any section of the body member 20. The side sections 28 of the body member 20 may include the light source 4 and may also include a plurality of openings 29 for facilitating the dissipation of heat generated by the light source 4. In an alternative embodiment of the high bay luminaire 10, the light source 4 may also be carried by the end sections 24 of the body member 20. In an embodiment, the plurality of openings 29 may increase airflow to cool the light source 4 integrated into the side sections 28. The body member 20 may also include a central section 22 that is connected to end sections 24.

The electrical sensor 1 may be configured to generate an operating signal that controls the operation of the high bay luminaire 10. The electrical sensor 1 may be any type of controller that detects a status relevant to the operation of the high bay luminaire 10 and generates an operating signal responsive to the detected status. Examples of sensors that may be included as the electrical sensor 1 include, without limitation, a motion detector, an occupancy sensor, a thermal detector, a timer, a wireless communication device, and the like. In the present embodiment, the electrical device is an occupancy sensor. The details regarding the operation of the occupancy sensory may be found in U.S. patent application Ser. No. 13/464,345 which has been incorporated by reference hereinabove.

The electrical sensor(s) 1 on a luminaire may enable a luminaire to operate in concert with other luminaires. The electrical sensor 1 may cause a high bay luminaire 10 or multiple high bay luminaries 10 to illuminate particular areas in a sequence where the high bay luminaires 10 turn on in a defined pattern. Alternatively, the electrical sensor 1 may cause all of the high bay luminaires 10 or a group of the high bay luminaires 10 to illuminate simultaneously. The electrical sensor 1 may communicate with the other high bay luminaires 10 via a wired or wireless connection.

Figure 5:
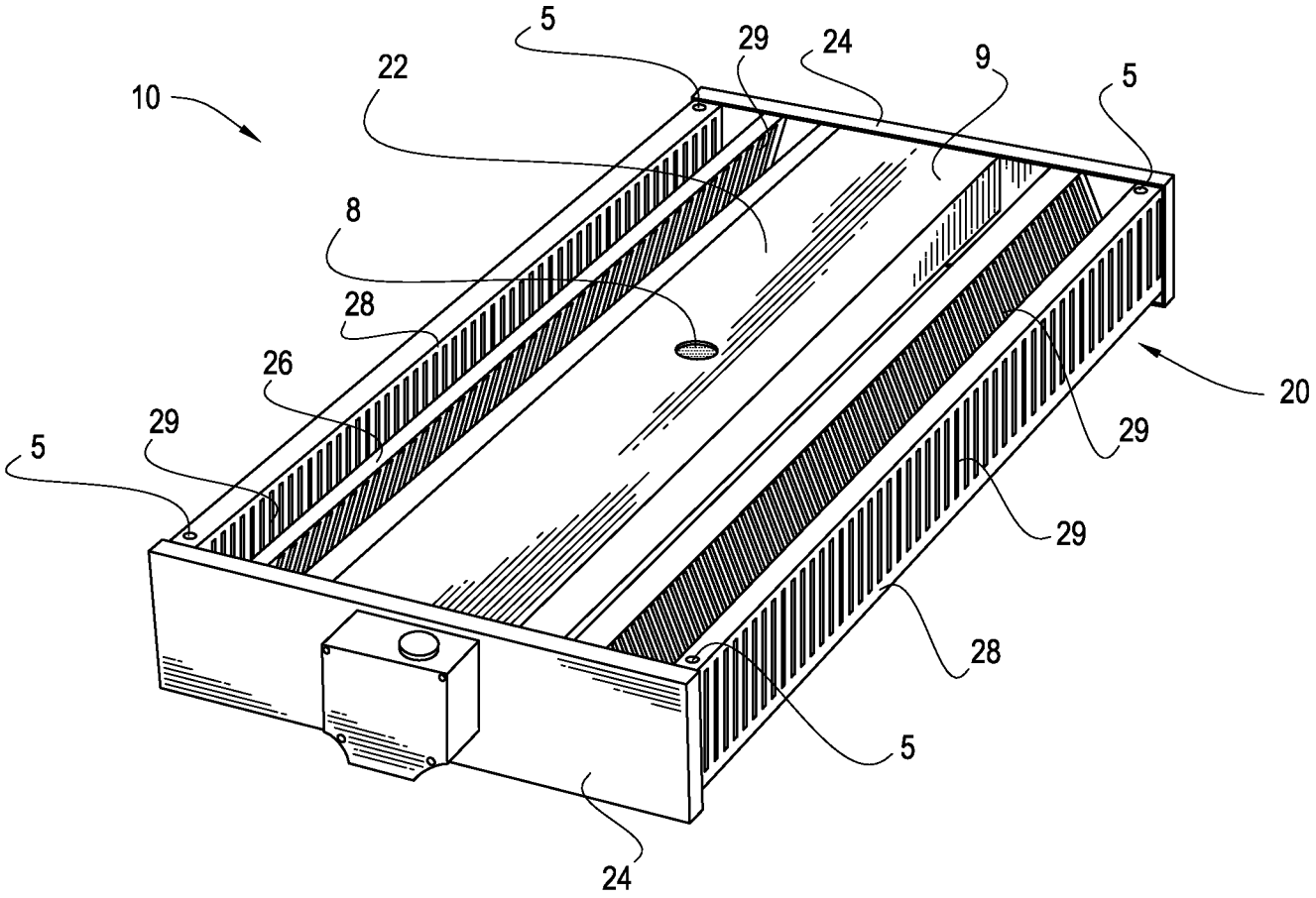
FIG. 5 is a top perspective view of the high bay luminaire illustrated in FIG. 1.

Referring to FIG. 5, the high bay luminaire 10 may include a chain mounting 5 or aircraft/chain mounting 5, an access plate 9, a hook mounting 8 or pendant/hook mounting 8. The high bay luminaire 10 may further include uplight modules (not illustrated). The uplight modules indicate the surface to which a light source 4 may be attached in an alternative embodiment. The chain mounting 5 and hook mounting 8 may be used to mount the high bay luminaire 10 either individually or as a combination. The access plate 9 may be removable and enables a user to install any necessary wiring. It is contemplated, however, that the access plate 9 may not be removable, and that any installation necessary wiring may be accomplished by accessing the cavity 31 through the power supply cover 3. The high bay luminaire 10 also features uplight modules which, when installed, allow for uplighting as well as downlighting. As a result, a user may utilize either downlighting, uplighting or both as needed. This advantageously allows for enhanced emission of light when using the high bay luminaire 10 according to embodiments of the present invention.

In some embodiments, where the light source 4 is provided by LEDs, the LEDs may generate heat which must be effectively dissipated to ensure reliable operation thereof. The heat produced by the LEDs may be conducted through a circuit board (not shown), to at least one of the side sections 28 and the intermediate sections 26 and dissipated through the plurality of openings 29. Natural air convection may also assist in dissipating the heat to the air of the environment. To further improve heat dissipation, an embodiment may include an active component for cooling any of the various heat-dissipating elements of the high bay luminaire 10, such as a fan. The LEDs of the current invention are configurable so that a user may vary the color rendering index, color temperature and the brightness of the light emitted from the light source 4.

Figure 6:
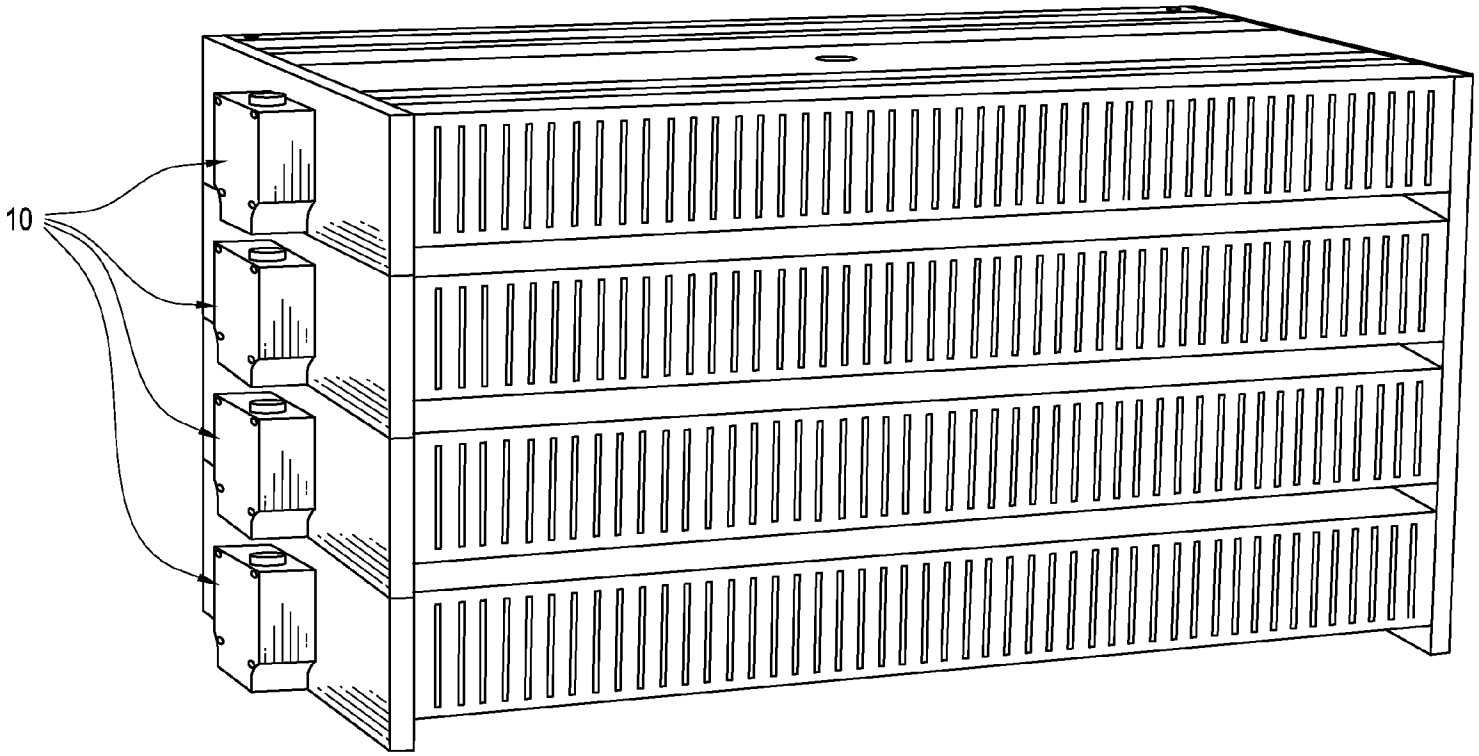
FIG. 6 is a side perspective view of a plurality of high bay luminaires positioned in a stacked configuration.

Referring to FIG. 6, advantageous features of the invention related to stacking of a plurality of high bay luminaires 10 are illustrated. The ability to stack or nest a plurality of the high bay luminaires 10 is advantageous in terms of reducing shipping and storage costs as the nested high bay luminaires 10 occupy less space and reduce the amount of packaging that would be typically required for shipping. The light sources 4 may be recessed from the end sections 24 in each of the high bay luminaires 10 to protect the light sources 4 during shipping. For example and without limitation, the light sources 4 may be recessed at least about 1/16 of an inch from or above a bottom portion of the end sections 24. When stacked, no portion of the top of the high bay luminaire 10 will be in contact with the light sources 4 of another high bay luminaire 10. Additionally, some sections of the body member 20 of a first high bay luminaire 10 may be configured to include features configured to cooperate with features of sections of a second high bay luminaire 10 to facilitate stacking. Such features may cooperate so as to facilitate the stacking process as well as prevent the relative movement of stacked high bay luminaires 10.

The high bay luminaire 10 may further include a lens. The lens may attach to the body member 20, the power supply cover 3, the access plate 9, the central section 22, the end section 24, the intermediate section 26, and/or the side section 28. Specifically, the lens may be attached and form an interference fit with the body member 20, the power supply cover 3, the access plate 9, the central section 22, the end section 24, the intermediate section 26, and/or the side section 28. The interference fit preferably provides sufficient strength to carry the lens. Optionally, the lens may be attached to the body member 20, the power supply cover 3, the access plate 9, the central section 22, the end section 24, the intermediate section 26, and/or the side section 28 through the use of an adhesive, glue, fastener, or any other attachment method known in the art.

The lens may be configured to interact with light emitted by the light source 4 to refract, reflect, or otherwise redirect incident light. Accordingly, the light source 4 may be disposed such that light emitted therefrom is incident upon the lens. The lens may be formed in any shape to impart a desired refraction. In the present embodiment, the lens has a generally curved geometry. Furthermore, the lens may be formed of any material with transparent or translucent properties that comport with the desired refraction to be performed by the lens. The high bay luminaire may include multiple lenses. The lens may be configured into any geometric configuration, including, without limitation, a curved, square, triangular, or any other geometric configuration known to skilled artisans without departing from the scope of the invention.

The high bay luminaire 10 may be configured into any geometric configuration, including, without limitation, a square, a circle, a triangle, or any other geometric configuration known to skilled artisans without departing from the scope of the invention.

Figure 7:
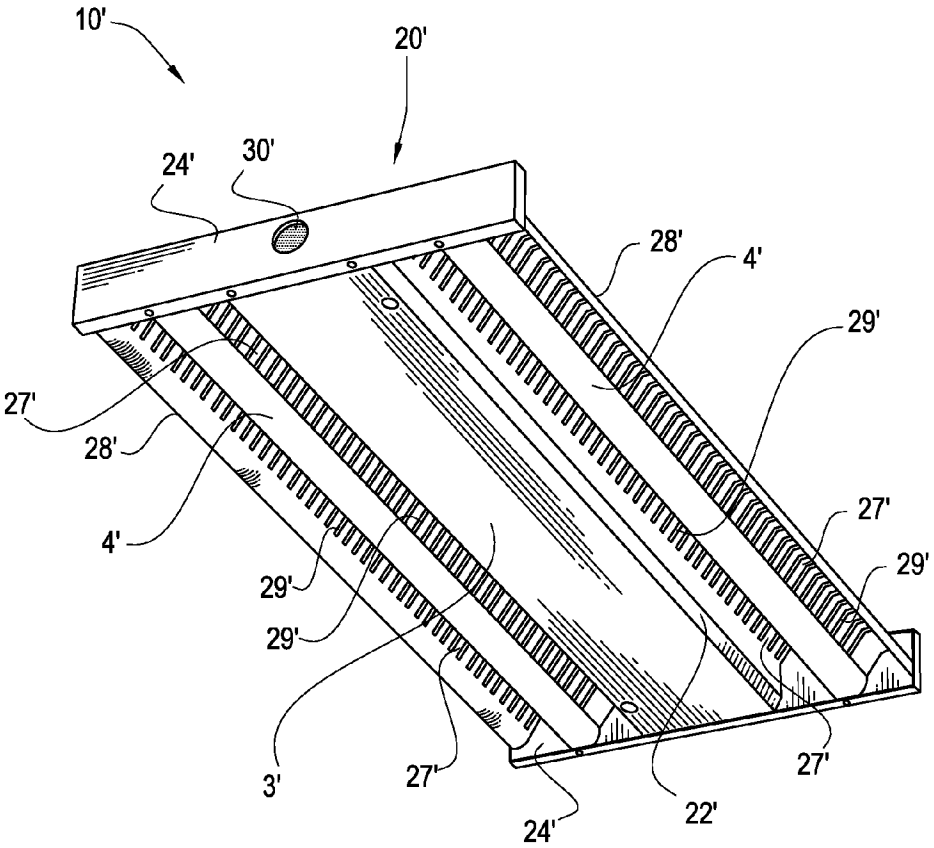
FIG. 7 is a bottom perspective view of a high bay luminaire according to an embodiment of the invention.
Figure 8:
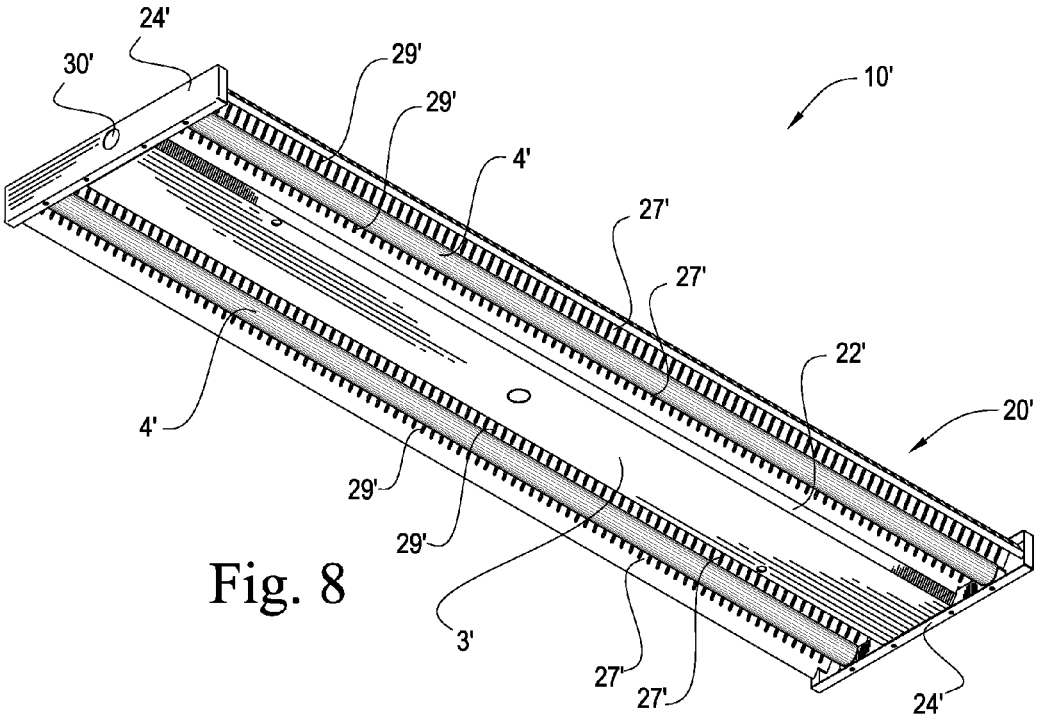
FIG. 8 is a bottom perspective view of the high bay luminaire illustrated in FIG. 7.
Figure 9:
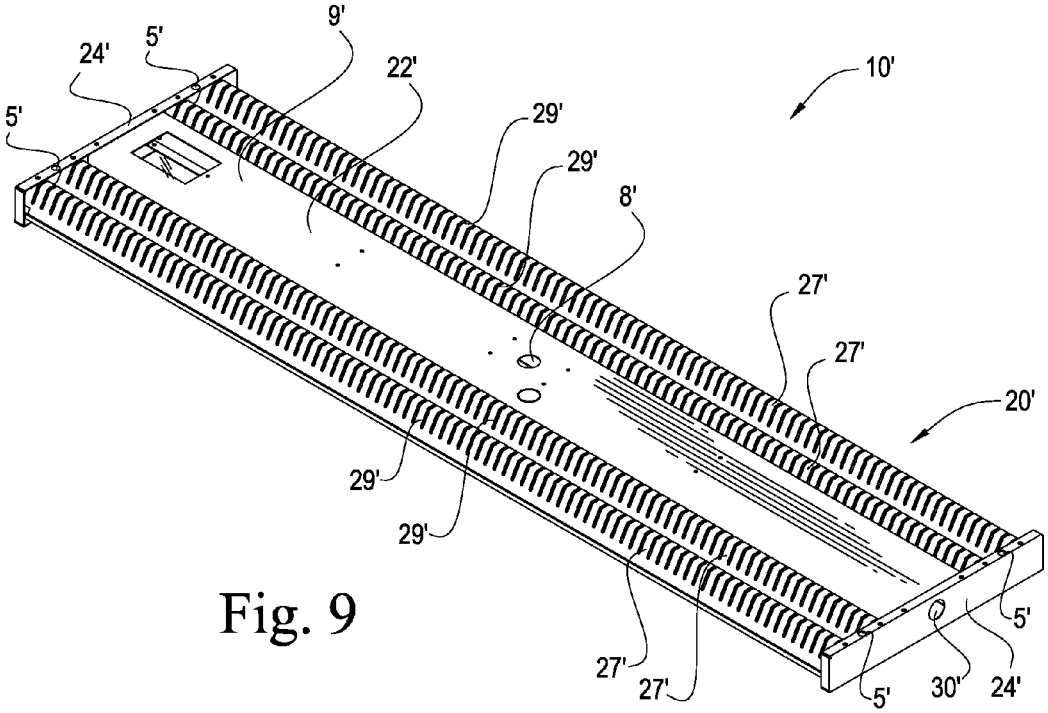
FIG. 9 is a top perspective view of the high bay luminaire illustrated in FIG. 7.
Figure 10:
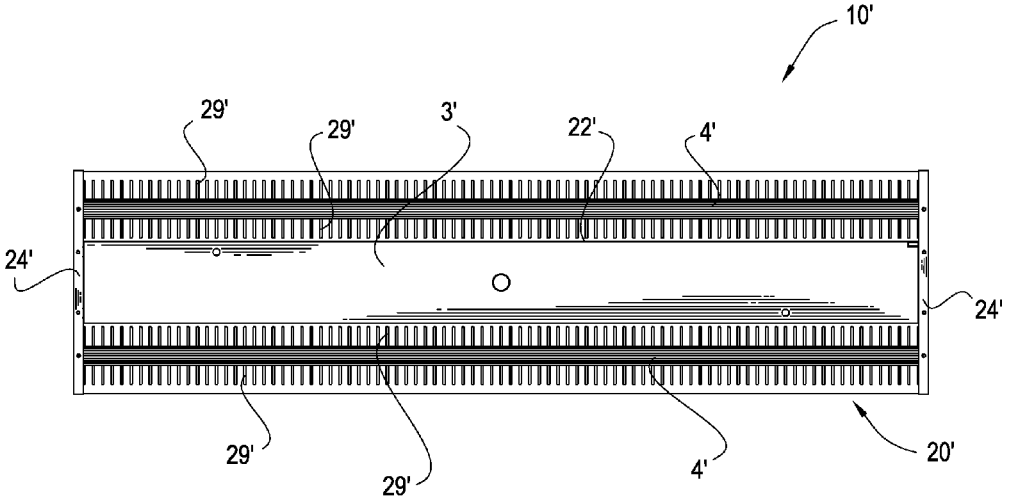
FIG. 10 is a bottom view of the high bay luminaire illustrated in FIG. 7.
Figure 11:
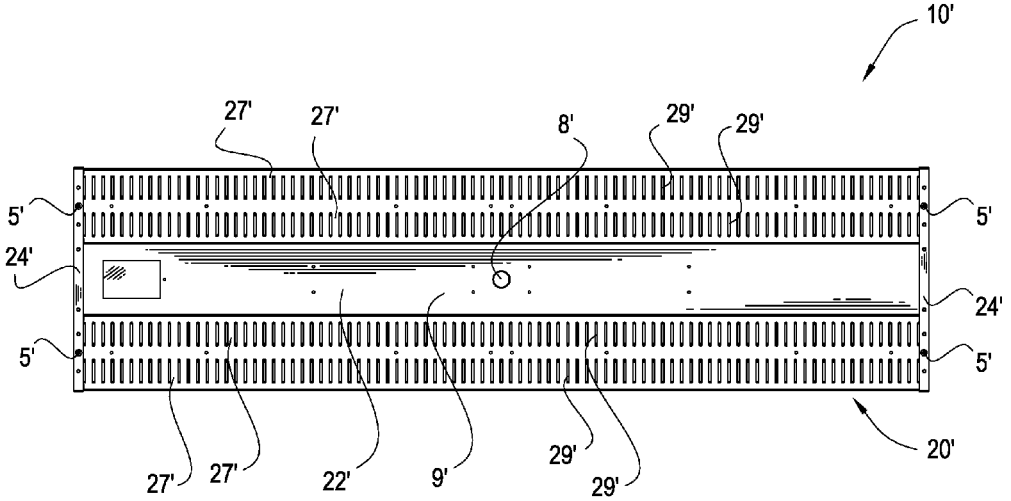
FIG. 11 is a top view of the high bay luminaire illustrated in FIG. 7.
Figure 12:
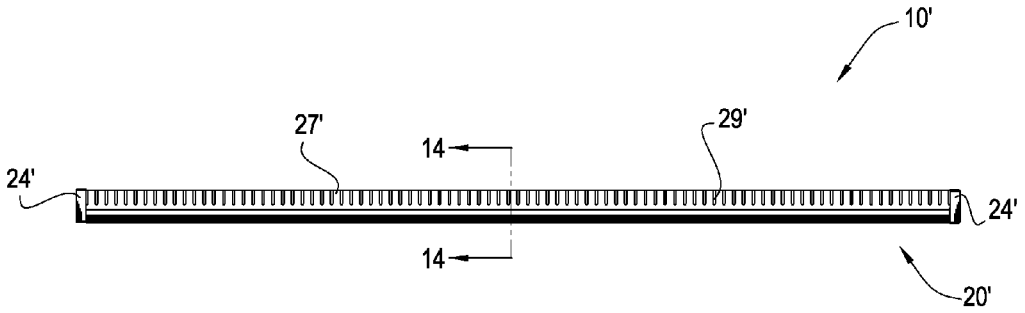
FIG. 12 is side elevation view of the high bay luminaire illustrated in FIG. 7.
Figure 13:
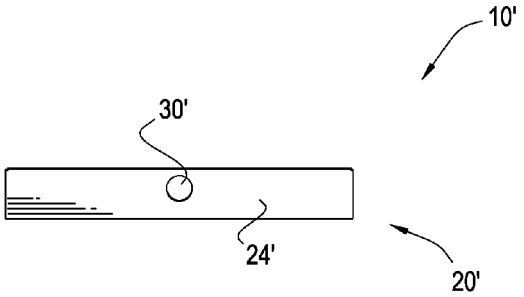
FIG. 13 is an end elevation view of the high bay luminaire illustrated in FIG. 7.
Figure 14:
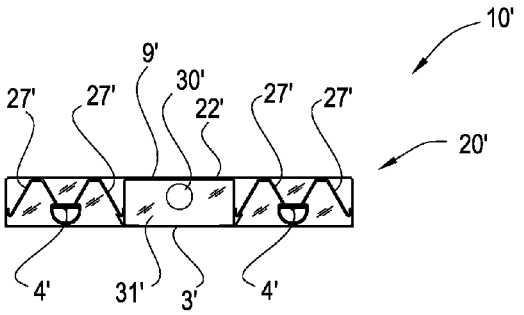
FIG. 14 is a cross section view of the high bay luminaire illustrated in FIG. 12 taken through line 14-14 of FIG. 12.

Referring to FIGS. 7-14, an alternative embodiment of a high bay luminaire 10' is described in greater detail. As shown in FIG. 7, a high bay luminaire 10' is presented that may be constructed in its entirety from sheet metal and feature a monolithic housing. A high bay luminaire 10' fabricated from sheet metal is very durable and lightweight. The high bay luminaire 10' in the present embodiment may have an altered configuration when compared to the high bay luminaire 10 depicted in FIGS. 1-6. The side sections 28' may be integrally formed into a perforated continuous sheet metal structure that curves to define a curved section 27' over the light source 4. Additionally, the curved section 27' may be configured so as to function as the heat sink in this embodiment and enable illumination through the plurality of openings 29' in the sheet metal. The curved section 27' may also consist of a different geometry without departing from the scope of the invention, such as a geometry devoid of curvature.

Additionally, in some embodiments, the curved section 27' may consist of a series of bends or curves and may include indentations, grooves, or other surface features that do not form an opening but do increase the thermal dissipation capacity of the body member 20'. The plurality of curved sections 27' may further include a plurality of upper surfaces, a bottom surface, and an interface surface. The light source 4' may be disposed on the interface surface. The bottom surface may include a coating, a conversion material, a refractive material, a reflective material, a silvered surface, a tinted surface, and a mirrored surface. The description of these configurations, however, are meant to be exemplary only and non-limiting. Furthermore, in some embodiments, the light source 4 may be attached to the underside of the curved section 27' as illustrated in FIG. 7. A light source 4' may also be attached to an uplight module (not illustrated) in the same manner as described above.

The lens may be attached to the curved section 27' and/or the uplight module. Specifically, the lens may be attached and form an interference fit with the curved section 27' and/or the uplight module. The interference fit preferably provides sufficient strength to carry the lens. Optionally, the lens may be attached to the curved section 27' and/or the uplight module through the use of an adhesive, glue, fastener, or any other attachment method known in the art.

Continuing to refer to FIGS. 7-14, additional aspects of the high bay luminaire 10' will now be discussed in greater detail. The high bay luminaire 10' may include a body member 20' which may include a plurality of end sections 24', a plurality of intermediate sections 26' which may be attached to the plurality of end sections 24', a central section 22' which may be positioned between the plurality of intermediate sections 26' and may be attached to the plurality of end sections 24', and a plurality of side sections 28' which may be attached to an end section 24' of the plurality of end sections 24' or an intermediate section 26' of the plurality of intermediate sections 26'. The high bay luminaire 10' may also include a power supply 2' and a light source 4'.

The light source 4' may be in electrical communication with the power supply 2'. A cavity 31' may be defined by the plurality of end sections 24' and the central section 22'. One of the plurality of end sections 24', the plurality of intermediate sections 26', the central section 22', and the plurality of side sections 28' may be formed of sheet metal.

The central section 22' may further include a power supply cover 3' and the cavity 31' may be defined additionally by the power supply cover 3'. The light source 4' may include a plurality of light sources 4' which may be disposed on the plurality of side sections 28' and the light source 4' may be in thermal communication with the plurality of side sections 28'.

The plurality of side sections 28' and/or the plurality of intermediate sections 26' may include a plurality of openings 29'. The plurality of side sections 28' and/or the plurality of intermediate sections 26' may be in thermal communication with the light source 4'.

The high bay luminaire 10' may further include an electrical sensor 1'. The electrical sensor 1' may include a controller which may be configured to detect a status relevant to the operation of the high bay luminaire 10' and may generate an operating signal responsive to the detected status. The electrical sensor 1' may further include a motion detector, an occupancy sensor, a thermal detector, a timer, and/or a wireless communication device. The electrical sensor 1' may be configured to communicate with other luminaires and/or other electrical devices via a wired connection and/or a wireless connection.

The high bay luminaire 10' may further include a chain mounting 5' and/or a hook mounting 8'. The high bay luminaire 10' may further include an access plate 9'. The high bay luminaire 10' may further include an uplight module which may be disposed on the plurality of intermediate sections 26', the plurality of side sections 28', and/or the plurality of end sections 24' and the light source 4' may be disposed on the uplight module.

Similar to the embodiment as depicted in FIG. 6, the body member 20' may be configured to be stackable with the body member 20' of another high bay luminaire 10'. The plurality of intermediate sections 26', the central section 22', and the plurality of side sections 28' may be fabricated of sheet metal. The power supply 2' may be positioned within the cavity 31' and the power supply cover 3', the plurality of end sections 24', and/or the central section 22' may include a passageway 30'. The high bay luminaire 10' may further include a battery which may be attached to the body member 20' and may be positioned in electrical communication with the power supply 2' and/or the light source 4'. The light source 4' may include a light emitting diode (LED).

In accordance with one embodiment of the invention, a method for forming a high bay luminaire 10 is provided. A method of creating a high bay luminaire 10 which may include a body member 20, a power supply 2, and a light source 4. The body member 20 may include a plurality of end sections 24, a plurality of intermediate sections 26 which may be attached to the plurality of end sections 24, a central section 22 which may be positioned between the plurality of intermediate sections 26 and may be attached to the plurality of end sections 24 at a generally central part of the plurality of end sections 24 and wherein a cavity 31 may be positioned, and a plurality of side sections 28 which may be attached to the plurality of end sections 24.

The method may include the steps of forming each end section 24 from a first piece of metal, forming each side section 28 from a second piece of metal, forming each intermediate section 26 from a third piece of metal, forming the central section 22 from a fourth piece of metal, assembling the plurality of end sections 24, the plurality of side sections 28, the plurality of intermediate sections 26, and the central section 22 to form the body member 20, and attaching the power supply 2 to the body member 20 and positioning the power supply 2 in electrical communication with the light source 4. The body member 20 may be configured to be stackable with the body member 20 of another high bay luminaire 10.

The method may further include the step of attaching the light source 4 to the body member 20. The method may further include the steps of attaching an electrical sensor 1 to the body member 20, attaching a chain mounting 5 and/or a hook mounting 8 to the body member 20, and attaching an access plate 9 to the body member 20.

The method may further include the step of forming a plurality of openings 29 in the plurality of side sections 28 and/or the plurality of intermediate sections 26. The plurality of side sections 28 and/or the plurality of intermediate sections 26 may be in thermal communication with the light source 4.

The method may further include the step of attaching an uplight module. The light source 4 may be disposed on the body member 20 and/or the uplight module.

In some embodiments, the method may include the step of forming a plurality of curved sections 27'. The plurality of curved sections 27' may be used in addition to or as a replacement to the plurality of side sections 28 and/or the plurality of intermediate sections 26. The plurality of curved sections 27' may be formed from a fifth piece of metal. The method may further include the step of forming a plurality of openings 29 in the plurality of curved sections 27'. The plurality of curved sections 27' may be in thermal communication with the light source 4. The light source 4 may be disposed on the plurality of curved sections 27'.

The first piece of metal, the second piece of metal, the third piece of metal, fourth piece of metal, and/or the fifth piece of metal may be sheet metal. At least two of the first piece of metal, the second piece of metal, the third piece of metal, fourth piece of metal, and the fifth piece of metal may be collectively formed from a single piece of metal. That is to say, where at least two of the first, second, third, fourth and fifth pieces of meal are formed from a single piece of metal, each of the elements of the high bay luminaire formed therefrom may be formed from the single piece of metal.

Those skilled in the art will recognize that the individual steps of the method are not necessarily required to be performed in any particular order. The order of the steps provided herein is only exemplary and any combination or order of the steps may be used unless a particular step requires a step prior to be accomplished before it. Furthermore, those skilled in the art will recognize that additional steps may be performed to form the high bay luminaire 10 or other components, members, or sections as described herein.

Those skilled in the art will recognize that when referencing various aspects of the invention, some objects are referred to in the singular and in the plural at different times. These terms are to be used interchangeably when able and these objects may be considered to meet the elements of the invention when the singular or plural terms are used.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed. Thus the scope of the invention should be determined by the appended claims and their legal equivalents, and not by the examples given.

What is claimed is:

1. A high bay luminaire system comprising:

a body member comprising:

a plurality of end sections, a plurality of intermediate sections attached to and extending between the plurality of end sections, a central section positioned between the plurality of intermediate sections and attached to the plurality of end sections, wherein a cavity is defined by an internal portion of the central section, and a plurality of side sections attached to and extending between the pair of end sections, each of the plurality of end sections having a bottom portion that contacts a bottom portion of a respective one of the intermediate sections, wherein at least one of the plurality of end sections, the plurality of intermediate sections, the central section and the plurality of side sections is formed of sheet metal; and a power supply; and a light source in electrical communication with the power supply.

2. A high bay luminaire system according to claim 1 wherein the central section further comprises a power supply cover; and wherein the cavity is defined additionally by the power supply cover.

3. A high bay luminaire system according to claim 1 wherein the light source comprises a plurality of light sources disposed on the plurality of side sections and wherein the light source is in thermal communication with the plurality of side sections.

4. A high bay luminaire system according to claim 1 wherein at least one of the plurality of side sections and the plurality of intermediate sections comprises a plurality of openings.

5. A high bay luminaire system according to claim 1 wherein at least one of the plurality of side sections and the plurality of intermediate sections is in thermal communication with the light source.

6. A high bay luminaire system according to claim 1 further comprising an electrical sensor.

7. A high bay luminaire system according to claim 6 wherein the electrical sensor comprises a controller configured to detect a status relevant to the operation of the high bay luminaire and generate an operating signal responsive to the detected status.

8. A high bay luminaire system according to claim 6 wherein the electrical sensor comprises at least one of a motion detector, an occupancy sensor, a thermal detector, a timer, and a wireless communication device.

9. A high bay luminaire system according to claim 6 wherein the electrical sensor is configured to communicate with at least one of other luminaires and other electrical devices via at least one of a wired connection and a wireless connection.

10. A high bay luminaire system according to claim 1 further comprising an uplight module disposed on at least one of the plurality of intermediate sections, the plurality of side sections, and the plurality of end sections and wherein the light source is disposed on the uplight module.

11. A high bay luminaire system according to claim 1 wherein the body member is configured to be stackable with the body member of another high bay luminaire system.

12. A high bay luminaire system according to claim 1 wherein the power supply is positioned within the cavity; wherein at least one of the power supply cover, the plurality of end sections, and the central section comprises a passageway.

13. A high bay luminaire system according to claim 1 further comprising a battery attached to the body member and positioned in electrical communication with at least one of the power supply and the light source.

14. A high bay luminaire system according to claim 1 wherein the light source comprises a light emitting diode (LED).

15. A high bay luminaire system comprising:

a body member comprising:

a plurality of end sections, a plurality of curved sections connected to and extending between the plurality of end sections, each of the plurality of curved sections comprising at least one of a curve, a bend, an indentation, and a groove, and a central section positioned between the plurality of curved sections and attached to the plurality of end sections at a generally central part of the plurality of end sections and wherein a cavity is defined, wherein the central section and the plurality of curved sections are integrally formed as a monolithic unit; and a power supply; and a light source that is in electrical communication with the power supply;

wherein the plurality of curved sections is in thermal communication with the light source.

16. A high bay luminaire system according to claim 15 wherein each of the plurality of curved sections is integrally formed into a continuous sheet metal structure that comprises a plurality of openings.

17. A high bay luminaire system according to claim 15 wherein the plurality of curved sections comprises a plurality of upper surfaces and an interface surface; wherein the light source is disposed on the interface surface.

18. A high bay luminaire system according to claim 17 wherein the plurality of curved sections comprises a bottom surface; wherein the bottom surface comprises at least one of a coating, a conversion material, a refractive material, a reflective material, a silvered surface, a tinted surface, and a mirrored surface.

19. A high bay luminaire system according to claim 17 further comprising an uplight module disposed on at least one of the plurality of intermediate sections, the plurality of curved sections, and the plurality of end sections and wherein the light source is disposed on the uplight module.

20. A high bay luminaire system comprising:

a body member comprising:

a plurality of end sections, a plurality of intermediate sections attached to and extending between the plurality of end sections, a central section positioned between the plurality of intermediate sections and attached to the plurality of end sections and a power supply cover, wherein a cavity is defined by an internal portion of the central section and the power supply cover, and a plurality of side sections attached to and extending between the pair of end sections, each of the plurality of end sections having a bottom portion that contacts a bottom portion of a respective one of the intermediate sections, wherein at least one of the plurality of end sections, the plurality of intermediate sections, the central section and the plurality of side sections is formed of sheet metal, wherein at least one of the plurality of side sections and the plurality of intermediate sections is in thermal communication with the light source; and a power supply positioned within the cavity; and a light source in electrical communication with the power supply;

wherein the light source comprises a plurality of light sources disposed on the plurality of side sections and wherein the light source is in thermal communication with the plurality of side sections; and wherein the body member is configured to be stackable with the body member of another high bay luminaire system.

21. A high bay luminaire system according to claim 20 further comprising at least one of a motion detector, an occupancy sensor, a thermal detector, a timer, and a wireless communication device.

* * * * *